US005289645A

United States Patent [19]

Marega et al.

[11] Patent Number: 5,289,645

[45] Date of Patent: Mar. 1, 1994

[54] INNER LINING FOR SKI BOOTS HAVING A ONE PIECE TONGUE ASSEMBLY

[75] Inventors: Antonello Marega, Montebelluna; Andrea Gabrielli, Predazzo, both of Italy

[73] Assignee: Calzaturificio Tecnica SpA, Treviso, Italy

[21] Appl. No.: 83,394

[22] Filed: Jun. 29, 1993

Related U.S. Application Data

[63] Continuation of Ser. No. 606,594, Oct. 31, 1990, abandoned.

[30] Foreign Application Priority Data

Nov. 9, 1989 [IT] Italy ..... 22069 B/89

[51] Int. Cl.[5] ..... A43B 23/26

[52] U.S. Cl. ..... 36/54; 36/10; 36/55; 36/117

[58] Field of Search ..... 36/117, 118, 119, 120, 36/121, 55, 88, 9 R, 10, 93, 54, 10

[56] References Cited

U.S. PATENT DOCUMENTS

| | | | |
|---|---|---|---|
| 2,343,477 | 3/1944 | Ross | 36/10 |
| 3,419,974 | 1/1969 | Lange | 36/119 X |
| 3,848,287 | 11/1974 | Simonsen | 36/119 X |
| 4,523,392 | 6/1985 | Gabrielli | 36/88 X |
| 4,839,973 | 6/1989 | Dodge | 36/119 X |
| 4,910,889 | 3/1990 | Bonaventure et al. | 36/117 |
| 4,920,666 | 5/1990 | Marega | 36/10 X |

FOREIGN PATENT DOCUMENTS

| | | | |
|---|---|---|---|
| 0107841 | 5/1984 | European Pat. Off. | 36/117 |
| 0227130 | 7/1987 | European Pat. Off. | 36/117 |
| 0308368 | 3/1989 | European Pat. Off. | 36/117 |
| 0370948 | 5/1990 | European Pat. Off. | 36/117 |
| 2230155 | 12/1974 | France | 36/119 |
| 2-063405 | 3/1999 | Japan | 36/117 |
| 0626793 | 12/1981 | Switzerland | 36/117 |

*Primary Examiner*—Paul T. Sewell
*Assistant Examiner*—BethAnne C. Cicconi
*Attorney, Agent, or Firm*—Griffin, Butler, Whisenhunt & Kurtossy

[57] ABSTRACT

In an inner lining shoe (10) for ski-boots an integral or one piece tongue assembly (12) consists of a tongue (14) connected to a fore part of upper (16), said fore part of upper (16) being joined to a rear portion of upper (20) by means like sewings (34,36) and to a sole (24) by joining its lower peripheral edge (38) to a peripheral edge (40) of said sole.

6 Claims, 3 Drawing Sheets

INNER LINING FOR SKI BOOTS HAVING A ONE PIECE TONGUE ASSEMBLY

This application is a continuation of Ser. No. 07/606,594, filed Oct. 31, 1990, now abandoned.

The present invention relates to an inner lining shoe to be put on within a rigid boot, such as a ski-boot with fore entry, in which the standard tongue is integrally formed with part of the upper of the lining shoe.

It is known that the lining shoes to be used together with ski-boots are provided at their leg portion with tongues having the purpose of shielding the leg from a direct contact with the rigid shell of the boot. Usually the tongues provided in the lining shoes to be inserted into a ski-boot are either fastened to the upper, for example by sewing, or secured in a floating manner, namely anchored to the upper by means permitting a sliding motion thereof in a longitudinal direction with respect to said upper in order to permit said tongue to be positioned in the most adequate manner with respect to the upper in order to fully fit the foot to the shoe and thus to the boot.

Said means for anchoring the tongue to the upper consist of a sewing or of a pin-like member slidable within a groove of the upper and may cause thickenings or greater encumbrances just at the level of the foot back wherein said thickenings can create uncomfortable situations which are difficultly bearable especially in sportwear, such as the ski-boots, in which said situations are to be avoided as much as possible.

In order to eliminate these drawbacks it has been thought to provide an improved inner lining shoe wherein the tongue is made integrally with part of the upper so as to prevent a thickening due to sewings or to slidable anchoring means from occurring at the foot back level, at which the tolerance spaces between the foot and the rigid shell of the boot are minimum.

Preferably the part of the upper integrally formed with said tongue is an extension of the tongue itself shaped as a fore part forming the toe portion of the shoe which can be connected to the remainder of the upper by means of sewing stitches remote from the foot back, i.e. at positions in which a possible sewing does not cause any relevant drawback.

More preferably, said tongue is integrally formed with the part forming the whole toe portion of the upper with a peripheral lower edge which can be anchored and secured to the sole of the shoe and two rear sides which can be sewed to the remaining part of the upper.

The features and advantages of the present invention shall more clearly appear from the following description of a preferred embodiment thereof, not to be construed in a imitating sense, with reference to the accompanying drawings, in which.

Figure 1:
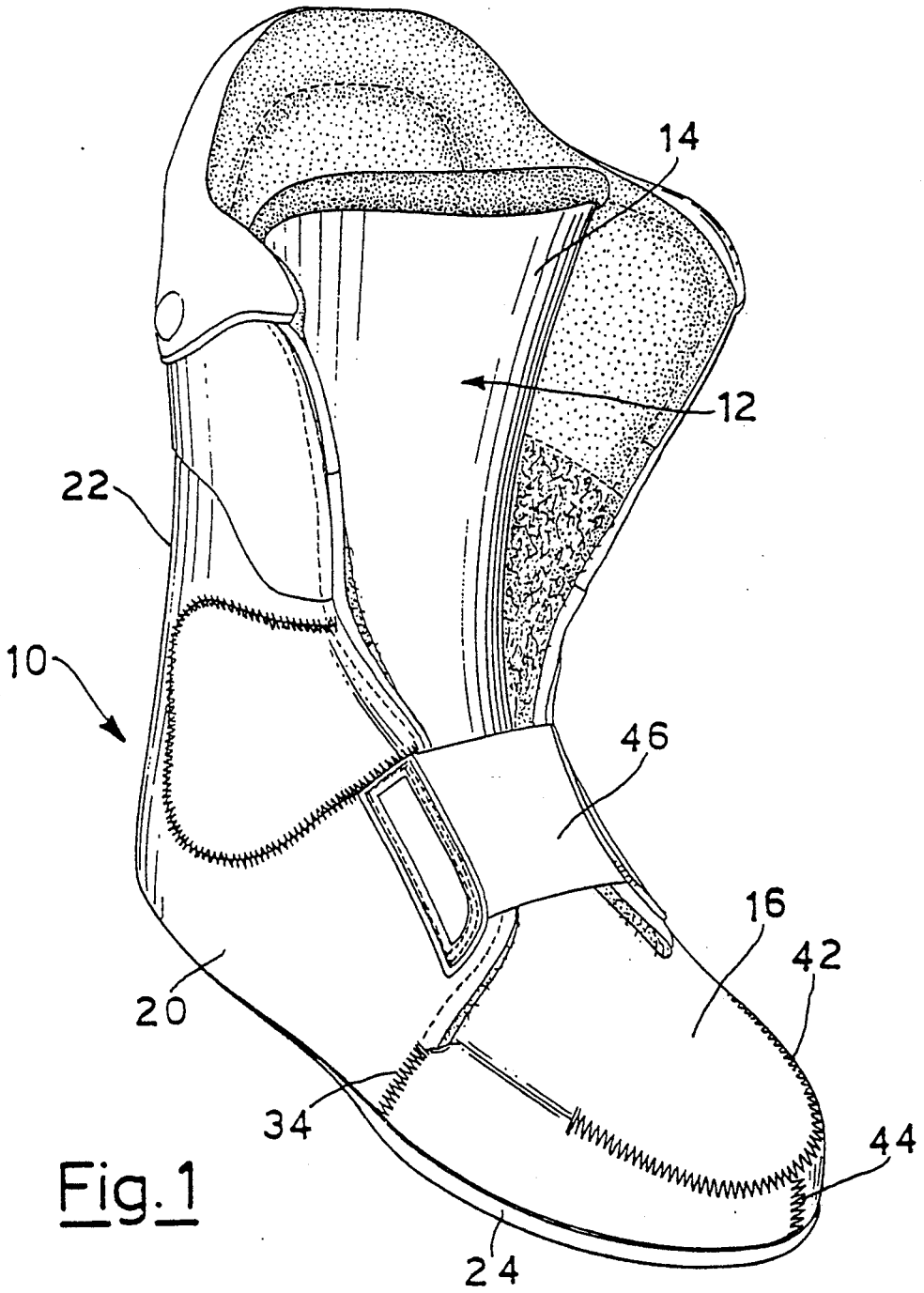
FIG. 1 is a perspective view of a wearable shoe comprising a tongue assembly according to the present invention.
Figure 2:
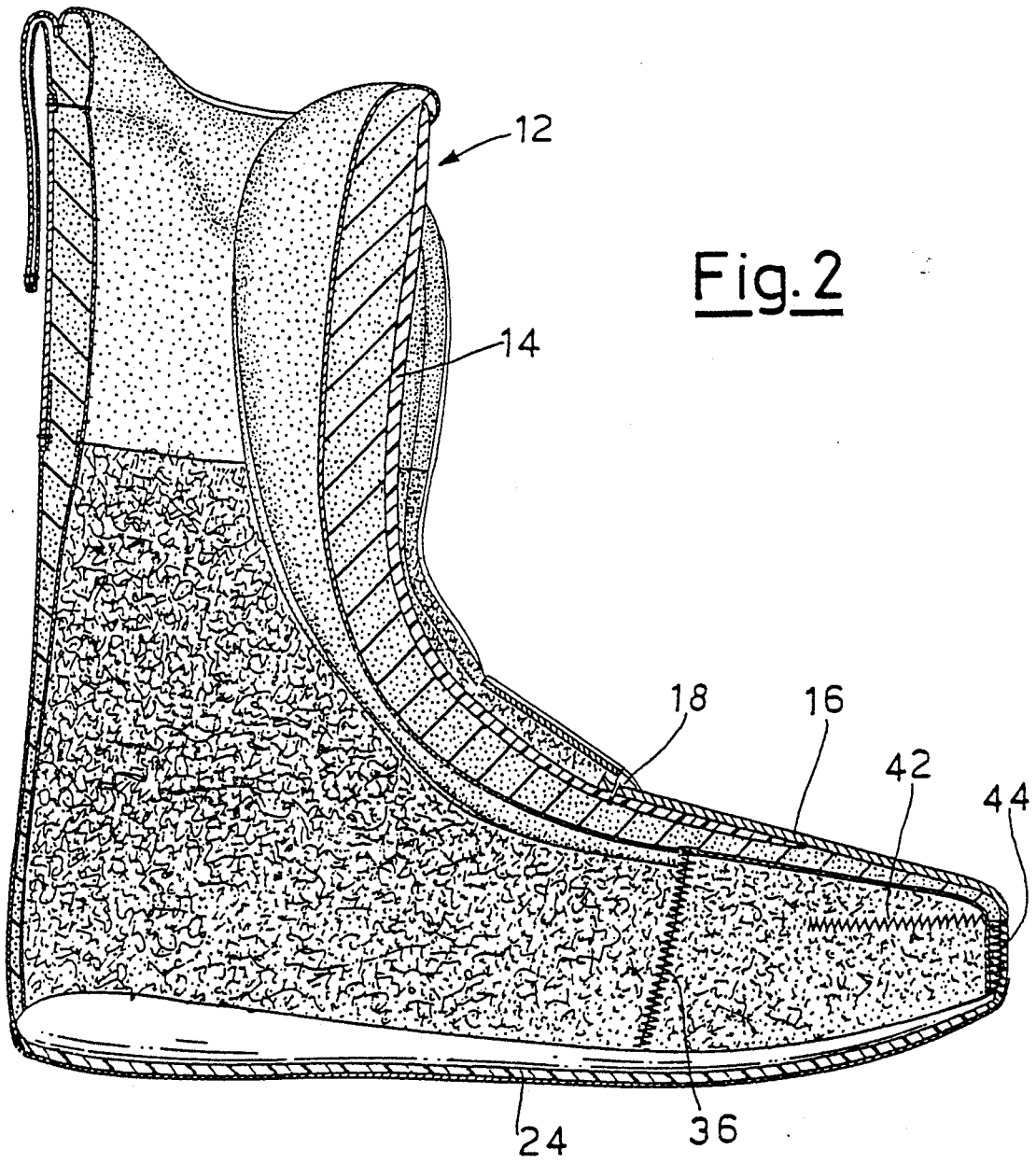
FIG. 2 is a cross-section view of the same lining shoe particularly showing the tongue assembly of the present invention.
Figure 3:
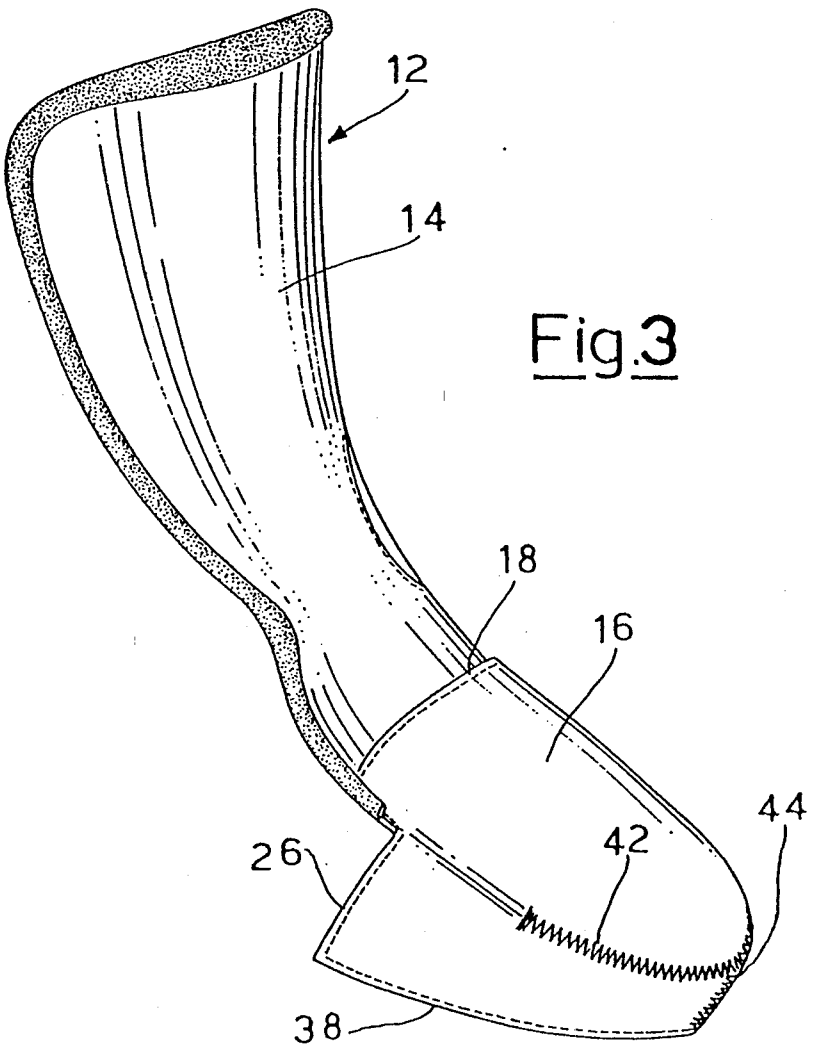
FIG. 3 is a perspective view of a tongue assembly according to the present invention shown in a condition removed from the remainder of the shoe.
Figure 4:
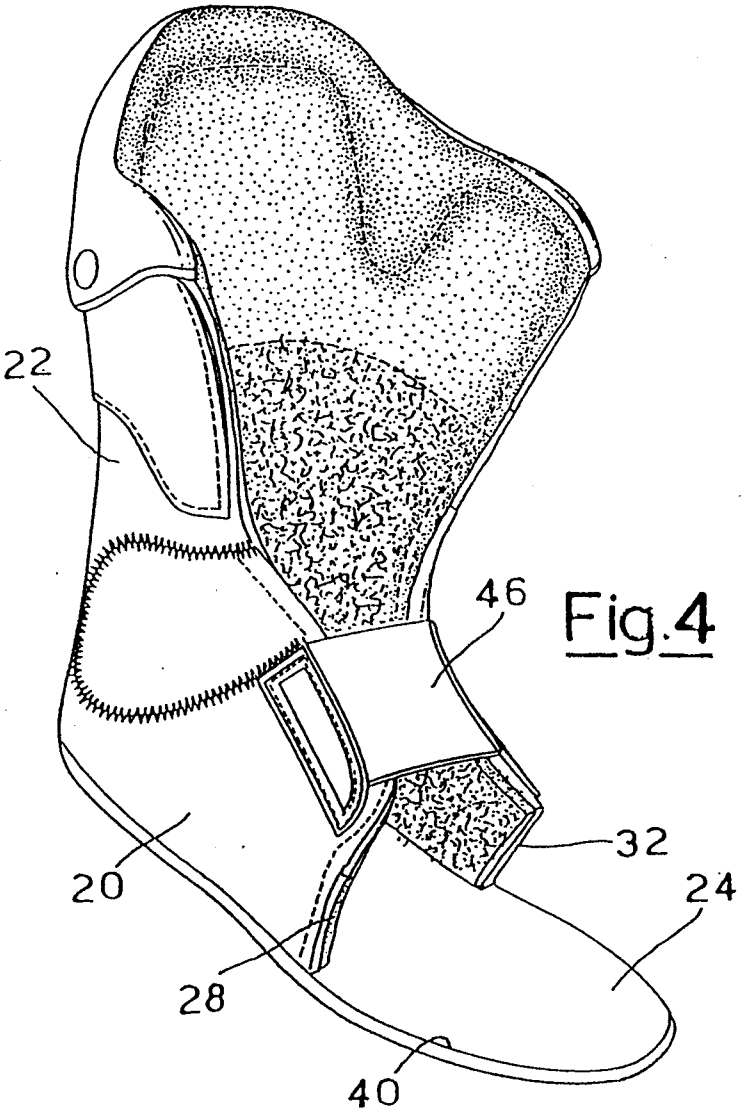
FIG. 4 is a perspective view of the remaining part of the shoe adapted for the connection to the tongue assembly of FIG. 3.

Referring to the above figures; the shoe 10 comprises an integrally formed tongue assembly according to the present invention consisting of the proper tongue 14 joined to a fore portion 16 of the upper by suitable means such as for example the sewing 18 (better viewable in FIG. 3). The upper is also formed by a remaining remaining portion 20 including a leg part 22 and is connected to a sole 24 by per se known means, such as cementing or thermowelding of parts containing adhesive means, by melting and solidifying again. Said integrally formed tongue assembly 12 is provided in the fore part 16 of the upper with side edges, the edge 26 of which can be seen, which are joined to corresponding fore edges 28 and 32 of the rear part 20 of the upper by means of sewings such as the sewing 34 shown in FIG. 1 and the sewing 36 shown in FIG. 2. The aforesaid fore portion 16 of the upper is also provided with a lower peripheral edge 38 which can be coupled with a peripheral edge 40 of said sole 24 and can be joined thereto by known means, such as cementing or thermowelding.

Owing to obvious manufacturing reasons the fore portion 16 of the upper is provided with sewings 42 and 44 permitting it to be given the desired shape and function.

For sake of description completeness an elastic ribbon 46 is shown having the purpose of causing the shoe and particularly the upper thereof to adhere to the internally fitted foot.

A particular advantage of a shoe provided with a tongue assembly according to the present invention is the reduction of the number of spare parts to be stored, since for the series manufacturing of these shoes it is sufficient to have available one type of tongue assembly for each shoe size and one type of shoe remaining part every two shoe sizes whereby the number of types of shoe remaining parts to be stored is reduced to one half. If consideration is paid to the fact that said shoe remaining parts ire the greater part of the shoe the storage economy which can be attained is evident.

The above description relates to a specific embodiment of the present invention which is not to be interpreted in a limiting sense and it will be evident that substituting equivalent parts shall be conceivable for those skilled in this field upon reading the above description. For example the sewings 34 and 36 might be substituted for by cementing or thermowelding joints and the connection between the peripheral edges 38 and 40 might be effected by sewing, as it is used in the shoe manufacturing technology.

We claim:

1. In a lining shoe for a fore-entry ski boot, said shoe having a sole, an upper part which includes a toe, a rear part which includes a heel, a leg part and a tongue assembly, the improvement wherein the tongue assembly comprises:

(a) a continuous tongue extending from near an uppermost part of the leg part to said upper part and being securely attached to the upper part at an uppermost edge thereof, said uppermost edge being at a vertical intermediate of position sole said and an ankle level of a wearer of the shoe;

(b) a depending portion of said upper part securely attached to said sole; and (c) a depending portion edge securely attached to a free edge of said rear part, said free edge being at a position between said toe and said uppermost edge of the upper part.

2. The lining shoe of claim 1 wherein the attachments are by at least one of sewings, cementings and thermowelds.

3. The lining shoe of claim 2 wherein the attachment of the depending portion to the sole is by at least one of thermowelds and sewings.

4. The lining shoe of claim 2 wherein the attachment of the tongue to the uppermost edge of the upper part and the attachment of depending portion edge to the free edge of the rear part is by sewing.

5. The lining shoe of claim 1 wherein an elastic ribbon is disposed across the attachment of the tongue to the upper part and the elastic ribbon is attached at its ends to opposite sides of the shoe.

6. The lining shoe of claim 1 wherein the tongue is attached to said uppermost edge along the entire width of the tongue at that attachment.

* * * * *